US010640998B2

(12) United States Patent
Andersen et al.

(10) Patent No.: US 10,640,998 B2
(45) Date of Patent: May 5, 2020

(54) MOBILE CONTAINER BUILDING FOR PERSONNEL DEPLOYED IN MILITARY, HUMANITARIAN AND/OR EXPEDITIONARY OPERATIONS

(71) Applicant: Kaercher Futuretech GmbH, Schwaikheim (DE)

(72) Inventors: S Harald Vige Teie Andersen, Sandfjord (NO); Thomas Popp, Stuttgart (DE)

(73) Assignee: KAERCHER FUTURETECH GMBH, Schwaikheim (DE)

( * ) Notice: Subject to any disclaimer, the term of this patent is extended or adjusted under 35 U.S.C. 154(b) by 0 days.

(21) Appl. No.: 16/176,857

(22) Filed: Oct. 31, 2018

(65) Prior Publication Data

US 2019/0136552 A1 May 9, 2019

(30) Foreign Application Priority Data

Nov. 6, 2017 (EP) ..... 17200189

(51) Int. Cl.
*E04C 2/52* (2006.01)
*E04H 1/12* (2006.01)
(Continued)

(52) U.S. Cl.
CPC ..... *E04H 1/1266* (2013.01); *E04B 1/34336* (2013.01); *E04H 1/1205* (2013.01);
(Continued)

(58) Field of Classification Search
CPC ..... E04B 1/34336; E04B 1/34869; E04B 2001/3577; E04H 1/1261; E04H 1/1205;
(Continued)

(56) References Cited

U.S. PATENT DOCUMENTS 7,921,562 B2 * 4/2011 Kiji ..... B23K 33/004 29/897
7,966,775 B2 * 6/2011 Medley ..... E04B 1/3444 52/79.5

(Continued)

FOREIGN PATENT DOCUMENTS

CN 201494829 U 6/2010
WO WO 2010/147797 12/2010

(Continued)

OTHER PUBLICATIONS

CMA CGM "The Finest Degree in Reefer Expertise" Available at www.cma-cgm.com; created Jul. 31, 2017.

*Primary Examiner* — Chi Q Nguyen
(74) *Attorney, Agent, or Firm* — Jason H. Vick; Sheridan Ross, PC

(57) ABSTRACT

A mobile container building for military, humanitarian and/or expeditionary applications has a transportable container with a floor panel, a ceiling panel and side walls, which together define an interior space having a longitudinal extent. An interior arrangement, which provides a functional working area for deployed personnel, is arranged in the interior space. The floor panel has a ribbed structure including a plurality of ribs evenly spaced apart from one another on a side oriented towards the interior space. A load-bearing steel sheet is secured onto the ribbed structure. The steel sheet covers the ribbed structure and carries the interior arrangement.

19 Claims, 5 Drawing Sheets

(51) Int. Cl.
*E04B 1/343* (2006.01)
*E04B 1/348* (2006.01)

(52) U.S. Cl.
CPC ..... *E04H 1/1216* (2013.01); *E04B 1/34869* (2013.01); *E04H 2001/1283* (2013.01)

(58) Field of Classification Search
CPC . E04H 1/1216; E04H 2001/1283; E04H 1/00; E04H 1/02; E04H 1/12
USPC ..... 52/79.1, 79.9, 79.5, 220.4, 302.1, 220.1, 52/143, 425; 454/187
See application file for complete search history.

(56) References Cited

U.S. PATENT DOCUMENTS 8,061,108 B2 * 11/2011 Tonyan ..... B28B 5/027 106/735
9,116,536 B2 * 8/2015 Hellriegel ..... G06F 1/183
2002/0078646 A1 * 6/2002 Eaton ..... E04B 5/36 52/292
2008/0060790 A1 3/2008 Yates et al.
2008/0134589 A1 * 6/2008 Abrams ..... E04B 1/003 52/79.1
2012/0147552 A1 6/2012 Driggers
2012/0279141 A1 * 11/2012 Wiederick ..... E04H 5/02 52/79.5
2013/0291449 A1 * 11/2013 Strickland ..... E04B 1/3442 52/79.5
2014/0008359 A1 1/2014 Ferren
2014/0090312 A1 * 4/2014 Medley ..... E04B 1/34357 52/79.5
2014/0298745 A1 * 10/2014 Rechenmacher ..... E04B 1/161 52/425
2015/0034634 A1 * 2/2015 Mullaney ..... E04B 1/3431 220/1.5
2016/0040443 A1 * 2/2016 Stephenson ..... E04H 1/005 52/79.5
2018/0010350 A1 * 1/2018 Sansom, III ..... E04H 1/1216

FOREIGN PATENT DOCUMENTS

WO WO 2014/056548 4/2014
WO WO 2016/020018 2/2016

* cited by examiner

MOBILE CONTAINER BUILDING FOR PERSONNEL DEPLOYED IN MILITARY, HUMANITARIAN AND/OR EXPEDITIONARY OPERATIONS

CROSS REFERENCES TO RELATED APPLICATIONS

This application claims priority under the Paris Convention from European patent application EP 17 200 189.3 filed on Nov. 6, 2017. The entire content of this priority application is incorporated herein by reference.

BACKGROUND

The present invention relates to a mobile container building for military, humanitarian and/or expeditionary operations, and in particular to a mobile sanitary container building.

US 2014/0008359 A1 discloses a container building, which accommodates both an interior arrangement installed in an operationally permanent manner in the interior space and also trolleys, the trolleys being able to provide various functional working areas depending on the desired application. The trolleys can be moved into the interior space and secured there for transport of the mobile container building. At a deployment site, the trolleys are moved out of the interior space and they provide a mobile workplace outside of the container building. Operationally permanently installed arrangements, such as cupboards mounted on the lateral interior walls and a work surface attached to an interior wall, remain in the interior space of the container building. The container building is based on a standard freight container (ISO container).

Such containers are typically used in sea freight shipping on container ships for the transport of goods of all kinds. They are usually made of steel, and they are stackable. In order to use such a ISO sea freight container as a mobile container building, it is known to clad the lateral steel walls and the ceiling panel from the inside and to provide insulation material. WO 2014/056548 A1 thus discloses, by way of example, a mobile container building comprising two interconnected ISO containers, which form a common interior space. The containers each have an interior wall cladding with a supporting structure made of wood and intermediate rafter insulation. Service ducts, which permit water pipes, electrical cables, fuel lines and the like to be brought inside the insulated interior walls, and thus to be concealed "in the wall" to some extent, are integrated into the supporting structure and the insulation. Such a fitting-out of an ISO container permits an individual, functionally adapted and "habitable" design and has proved to be effective in practice. However, the interior fitting-out of such an ISO freight container can be time-consuming and expensive.

WO 2016/020018 A1 discloses a further mobile container building having an operationally permanently installed interior arrangement. The interior arrangement in this case is configured for water treatment and water supply. The interior arrangement comprises a plurality of pipes, which are secured to the interior walls of the container and serve for a dual function. They are used on the one hand as water pipes, compressed air lines or the like. On the other hand, the pipes are configured to hold functional modules, such as a pump or a filter unit. The functional modules can be suspended from the pipes by means of coupling elements, which permits a very flexible and function-oriented arrangement of the interior space of container buildings of this kind.

A further mobile container building is known from US 2008/0060790 A1. In this case, the container building is a mobile data center. Various server cabinets intended to hold computers, data storage devices and cooling fans are installed in the interior space of the container. In this case, too, the container building is realized on the basis of an ISO freight container.

In the field of container shipping, there are various kinds of freight containers that are intended for different types of cargo. In addition to non-insulated steel containers, which have typically been used in the previously described container buildings, there are special containers, such as tank containers for liquid or gaseous hazardous cargos, what is known as flat rack containers without a roof and side walls, as well as specially insulated refrigerated containers (known as reefer containers) for the transport of perishable goods, such as foodstuffs. Reefer containers are double-walled containers that are provided with thermal insulation, which have on one end face either circular openings for the supply and removal of externally generated cooling air (known as porthole or conair containers), or which have an integral refrigeration unit (known as integral refrigerated containers or integral reefers). As a rule, the walls of refrigerated containers are made of aluminum, in order to compensate for the additional weight of the refrigeration installation. An aluminum construction having a plurality of ribs oriented in the longitudinal direction, which constitute cooling ducts for the circulation of the cooling air, is typically arranged on the floor of the refrigerated container. A brief description of reefer containers can be found, for example, in a brochure published by the CMA CGM GROUP at www.cma-cgm-.com.

CN 2014 94829 U discloses an interior cladding sheet having various layers, which is specifically intended for refrigerated containers.

A disadvantage of refrigerated containers, when compared with simple ISO containers made of steel, is the lower stability of the side walls, which is problematical in respect of an interior arrangement for the implementation of a mobile container building. Furthermore, refrigerated containers used as special containers are generally more expensive than simple ISO containers. As a result, it is readily acknowledged that ISO steel containers are used for the implementation of mobile container buildings.

SUMMARY

In view of the above, it is an object of the present invention to provide a container building for personnel deployed in military, humanitarian and/or expeditionary operations, which permits a more cost-effective implementation.

It is another object to provide a container building for personnel deployed in military, humanitarian and/or expeditionary operations, which permits a variable outfitting in a cost-effective manner.

In order to address these and other objects, there is provided a mobile container building for personnel deployed for at least one of military, humanitarian or expeditionary operations, comprising a transportable container having a floor panel, a ceiling panel and side walls, which together define an interior space having a longitudinal extent, and comprising an interior arrangement, which defines a functional working area for the deployed personnel within the interior space, wherein the interior arrangement is installed in an operationally permanent manner in the interior space, wherein the floor panel comprises a ribbed structure having a plurality of ribs evenly spaced apart from one another on a side oriented towards the interior space, with the ribs extending in the longitudinal extent and forming a plurality of ducts evenly spaced apart from one another, wherein a load-bearing steel sheet is secured onto the ribbed structure such that it essentially covers the ribbed structure, and wherein the load-bearing steel sheet carries the interior arrangement.

There is also provided a mobile container building for personnel deployed in military, humanitarian or expeditionary operations, comprising a transportable container having a floor panel, a ceiling panel and side walls, which together define an interior space having a longitudinal extent, with the floor panel having a ribbed structure comprising a plurality of ribs extending in the longitudinal extent and forming a plurality of ducts evenly spaced apart from one another, comprising a load-bearing steel sheet secured onto the ribbed structure so as to cover the ribbed structure, and comprising an interior arrangement defining an operating area for the deployed personnel within the interior space, wherein the interior arrangement has a total weight, wherein the load-bearing steel sheet completely covers the ribbed structure in the operating area, and wherein the interior arrangement is installed in an operationally permanent manner on the load-bearing steel sheet such that the load-bearing steel sheet supports more than 75% of the total weight.

The novel container building thus has a function-determining interior arrangement including furniture and/or equipment, such as cupboards, work tables, wash stands, coat and hat racks, benches, electrical equipment including computers, heaters and other appliances. The furniture and equipment are installed in an operationally permanent manner in the interior space and are predominantly and essentially supported on the load-bearing steel sheet. This means that the major part of the function-determining interior arrangement is positioned on the load-bearing steel sheet. The side walls and the ceiling panel have no supporting function or, at most, only a minor, secondary supporting function.

Notwithstanding, individual lightweight elements of the interior arrangement, such as a lightweight LED ceiling light or a self-adhesive mirror, may be secured to the lateral interior walls and/or to the ceiling panel. It is also within the scope that function-determining parts of the interior arrangement, in addition to being supported on the load-bearing steel sheet, may further be secured to the ceiling panel and/or to side walls, in particular in order to prevent clanging, rattling or banging during their intended use and/or during transport. In these cases, however, the weight of the parts is also predominantly and essentially supported on the load-bearing steel sheet. Accordingly, these parts would fall down in spite of their attachment in the absence of the support on the load-bearing steel sheet. In preferred exemplary embodiments, the steel sheet carries more than 75% of the total weight of the interior arrangement, and preferably more than 90%.

In some exemplary embodiments, the steel sheet has a thickness between about 3 mm to 10 mm, in particular about 4 mm to 5 mm. The steel sheet covers the ribbed structure and thus forms an even floor. The side walls serve as—preferably insulated—exterior walls without any significant load-bearing function. The ribbed structure instead forms a stable subfloor with a higher load-bearing capacity, to which the steel sheet is secured in preferred exemplary embodiments.

The novel container building can be implemented very cost-effectively on the basis of a refrigerated container (reefer container), in particular on the basis of an integral reefer. Accordingly, the transportable container in a preferred embodiment is a reefer container approved for sea freight shipping, preferably a 20-foot reefer container for the transport of foodstuffs. In preferred exemplary embodiments, the container is an integral reefer, albeit without integrated refrigeration units.

In spite of the disadvantages of reefer containers described above, a container building with the potential for flexible use can be implemented in this way in a very cost-effective manner. The thermal insulation characteristics of the refrigerated container can be advantageously used, and an insulating interior arrangement can be largely dispensed with. The static disadvantage of the insulation of a lightweight construction is advantageously compensated for by the function-determining parts of the interior arrangement being predominantly and essentially supported on the load-bearing steel sheet. The ribbed structure on the floor that is customary in reefer containers, which is usually provided for the circulation of the cooling air, is suited surprisingly well as a substructure for the load-bearing steel sheet.

The novel container building thus offers what is, on the whole, a very realistic possibility for implementation, in spite of the per se higher acquisition costs of a reefer container and in spite of the static disadvantages when compared with a steel container. The above-mentioned object is completely achieved.

In a preferred refinement, the side walls facing towards the interior space are seamlessly clad with stainless steel sheets.

Such a cladding permits very simple and thorough cleaning of the interior space during or after use by hosing down the interior space including the interior walls, for example with a high-pressure washer. The refinement is particularly advantageous if the container building accommodates a sanitary facility or a kitchen facility, of which the consequence is increased requirements in respect of hygiene. This refinement can also be implemented very cost-effectively on the basis of a reefer container, since reefer containers likewise have easily cleaned interior walls for the transport of foodstuffs.

In a further refinement, the load-bearing steel sheet completely covers the ribbed structure in the functional area and/or the working area. In some exemplary embodiments, the steel sheet is welded and/or screwed to the ribbed structure from above. In preferred exemplary embodiments, any holes which appear as a result of the welding and/or screwing are closed to make them liquid-tight. In some exemplary embodiments, mounting holes for securing the steel sheet to the ribbed structure are closed from above by welding.

This refinement is also highly advantageous in order to implement a hygienic and easily cleaned functional area and/or working area in the most cost-effective manner. The steel sheet of this refinement prevents small parts, dirt and the like from falling into the ducts of the ribbed structure and accumulating there.

In a further refinement, the load-bearing steel sheet has an upward-projecting end surface in the region of the side walls, in particular an L-shaped folded edge, and a downward-projecting sealing diaphragm, which engages around the upward-projecting end surface from above, is arranged on the side walls.

In this refinement, the steel sheet is attached to the side walls by means of a labyrinth seal. In preferred exemplary embodiments, a flexible sealing element, such as a rubber bead, a rubber lip, a foam pad, a silicone strip or the like, is arranged between the upward-projecting end face and the downward-projecting sealing membrane. The refinement permits a liquid-tight connection of the steel sheet to the side walls and advantageously helps to make the interior space of the container easy to clean, in particular with a high-pressure washer. The labyrinth seal also has the advantage that the side walls and the load-bearing steel sheet are able to move and deform relative to one another to a limited extent, but without stress cracks or other damage arising as a result. This is particularly advantageous in view of the envisaged mobile application of the novel container building.

In a further refinement, the side walls have a multi-layer structure with an integrated insulation material. Preferably, the ceiling panel also has a multi-layer structure with an internal, cladded insulation material.

Thermal insulation of the container building permits an extensive range of applications in very hot and very cold regions. This refinement can be implemented in a very simple and cost-effective manner by the use of a reefer container.

As already mentioned above, the transportable container therefore in the preferred embodiments is an integral reefer in the preferred refinements.

In a preferred refinement, the refrigerated container has a frame structure with mounting holes, to which an exterior wall with an integrated access door is secured. The exterior wall with the integrated access door is preferably present at one end on the narrow side of the container, and the exterior wall is secured to the frame structure from the outside, in particular by welding and/or screwing.

Commercially available integral reefers have a double door on one narrow side, which permits generously dimensioned access into the container. This double door is normally used for loading and unloading. On the opposite narrow side, integral reefers typically have an area that is prepared for mounting the integrated refrigeration units. The present refinement makes use of the mounting holes of an integral reefer that are present as standard, in order to mount an exterior wall with a further access door at that point. In some exemplary embodiments, this exterior wall is thermally and/or acoustically insulated. Technical apparatuses, such as a heating boiler, a water tank, an electrical switchboard with fuses and/or an electrical control unit, a gas, diesel or multi-fuel burner, pumps and the like can be arranged advantageously behind the exterior wall.

In a further refinement, the container building has lighting arranged on the ceiling panel and oriented towards the interior space, the lighting having electrical connecting cables which are openly routed or routed inside a visible cable duct.

In this refinement, a room lighting is secured to the ceiling panel, wherein the electrical connection cables are visibly routed, so to say "on wall". Such an interior fitting-out differs significantly from the interior fitting-out described in WO 2104/056548 A1, for example. The visible routing of the connection cables is a disadvantage, both for aesthetic reasons and also because of the risk of damage when used as intended. This disadvantage is compensated for by the cost advantages, however, which in particular permit the use of an integral reefer, in which the insulation and cladding that is present as standard is left untouched as far as possible. The attachment of a lighting to the ceiling panel is also possible in the case of an integral reefer because of the low weight that the ceiling panel is expected to bear as a result thereof. The lighting preferably comprises a plurality of LED elements, since such lighting offer a high light output at small dimensions and low weight.

In a further refinement, the container comprises, transversely to the longitudinal extent, an access opening having an unobstructed interior height and an unobstructed interior width, and the interior arrangement has a static installation height which is smaller than the unobstructed interior height. The steel sheet and the interior arrangement preferably have an overall width which is narrower than the unobstructed interior width of the access opening.

This refinement makes it possible to assemble the interior arrangement (at least the majority of the parts of the interior arrangement) on the steel sheet outside of the container and to push it into the interior space of the container in a pre-assembled state. It has emerged in the course of practical tests that this is entirely possible with the aid of fork-lift trucks. This refinement facilitates the assembly of the interior arrangement on the steel sheet and permits a further reduction in cost. ISO containers, including integral reefers, typically have a double door on a narrow side, through which loading with fork-lift trucks is possible. This refinement makes advantageous use of this double door in order for the interior arrangement, which has been largely pre-assembled on the steel sheet, to be pushed "as a whole" into the container, and then for it to be secured there to the ribbed structure.

In a further refinement, the load-bearing steel sheet extends in the longitudinal extent over only a part of the ribbed structure, and an interior wall, which delimits the functional area and/or the working area, is secured at the end of the load-bearing steel sheet. The interior wall is preferably installed subsequently, that is to say after pushing in the steel sheet, so that the interior wall occupies the entire interior height and interior width of the interior space of the container and bears against the side walls and the ceiling panel with as few gaps as possible.

This refinement is advantageous in order for a technical space, in which the above-mentioned apparatuses are accommodated, to be separated from the functional area and the working area for the deployed personnel. As a result of the fact that the load-bearing steel sheet does not extend over the entire area of the ribbed structure, the technical apparatuses can be cost-effectively secured directly to the ribbed structure. In addition, pushing-in of the steel sheet is easier in this refinement. This refinement helps to bring down the installation costs.

In a further refinement, technical supply units, such as a hot water tank, a burner, a control cabinet with electrical switchgear, pumps and the like are accordingly arranged on the ribbed structure on a side of the interior wall facing away from the functional area and/or the working area.

In this refinement, the ribbed structure with its ducts can be advantageously used in order to route installation cables on the floor of the container. In addition, this refinement permits the highly cost-effective use of a reefer container.

In a further refinement, the load-bearing steel sheet comprises a water drainage duct extending in the longitudinal direction. The water drainage duct advantageously extends as far as the (double) door of the container.

The integration of such a drainage duct in the steel sheet simplifies the installation and cleaning of the interior space of the container in a cost-effective manner. This refinement is particularly advantageous if the interior arrangement comprises shower cubicles and/or washing cubicles or other functional areas, in which water is used in larger quantities and/or for cleaning purposes.

In a further refinement, the interior arrangement comprises a number of wash basins and/or a number of showers, which are respectively supported on the load-bearing steel sheet.

As already mentioned above, the steel sheet together with the ribbed structure bears most of the weight of the wash basins and/or the showers. Advantageously, the wash basins and/or the showers are not hung on the side walls. This is a very advantageous use of the novel container building, in particular on the basis of an integral reefer.

BRIEF DESCRIPTION OF THE DRAWINGS

It will be appreciated that the features mentioned above and those yet to be explained below can be used not only in the respective proposed combination, but also in other combinations or in isolation, without departing from the scope of the present invention. In the drawings.

EMBODIMENTS

Figure 1:
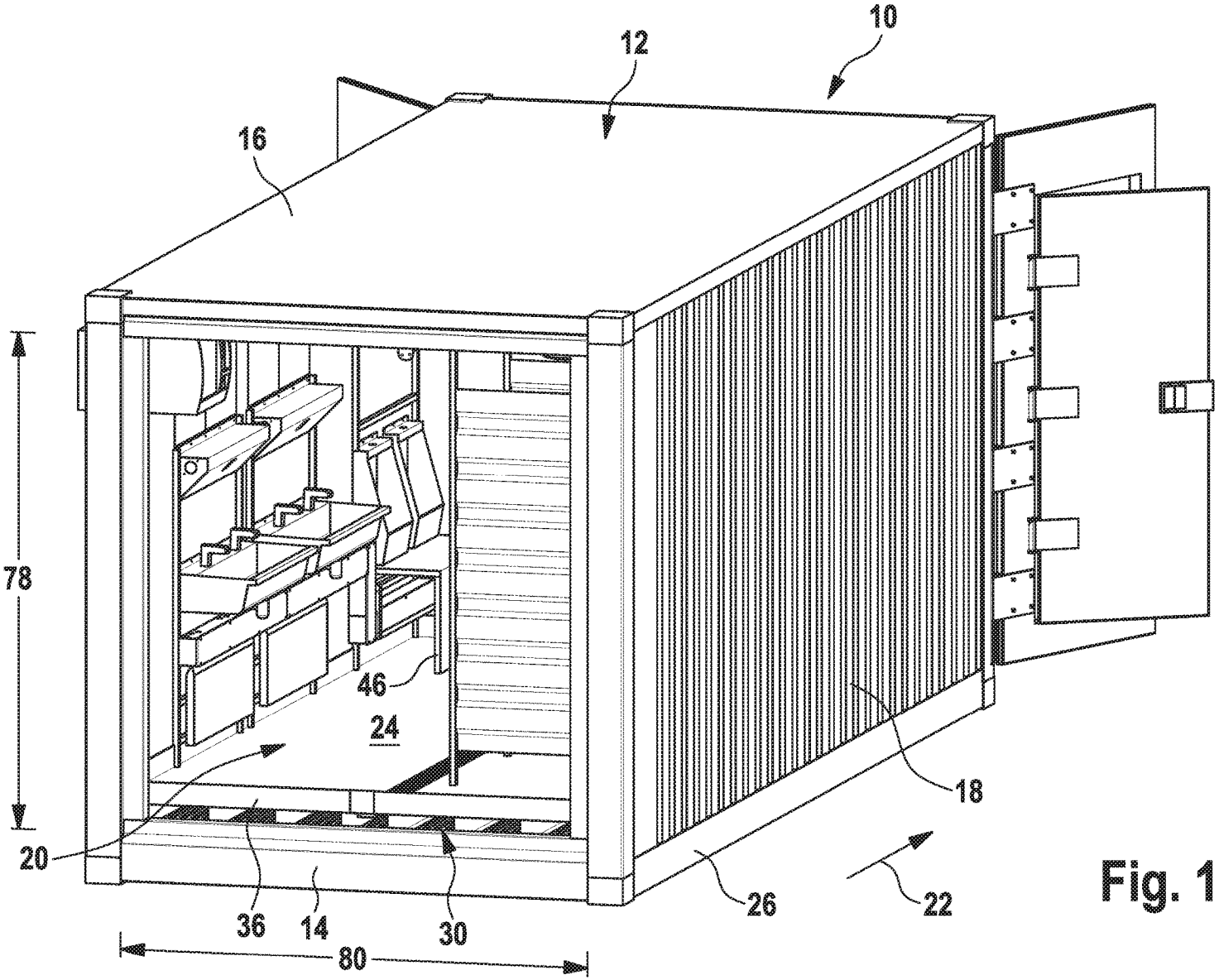
FIG. 1 shows an exemplary embodiment of the novel container building in a view obliquely from the front.
Figure 2:
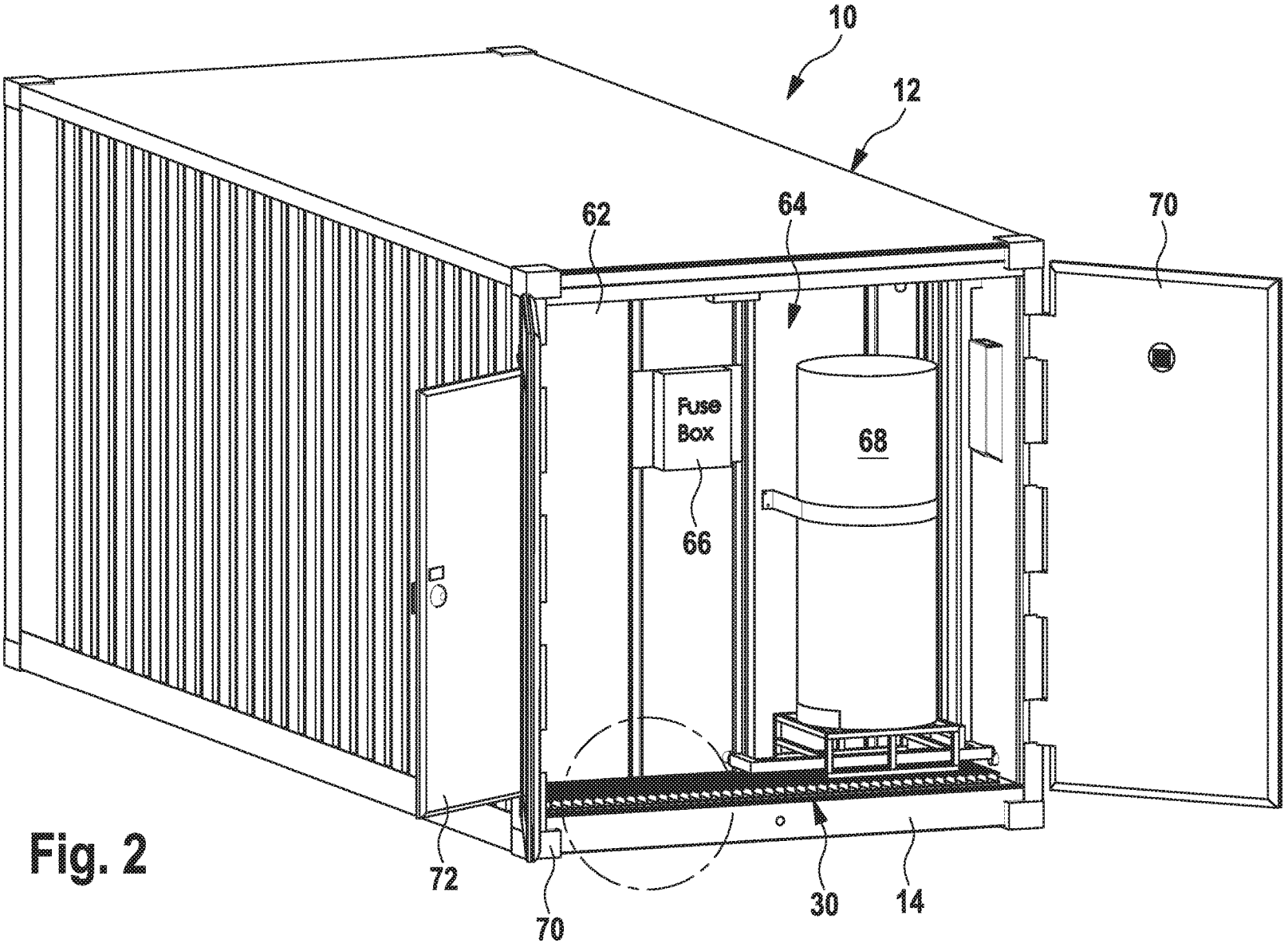
FIG. 2 shows the container building of FIG. 1 in a view obliquely from the rear.

An exemplary embodiment of the novel container building is referred to in FIGS. 1 and 2 with the reference number 10 in its entirety. In this exemplary embodiment, the container building 10 is a sanitary container building, which can be used as a shower room and wash room in military, humanitarian and/or expeditionary operations. This is a preferred exemplary embodiment. As an alternative, further exemplary embodiments can be adapted for other functions, such as kitchen container buildings, sleeping container buildings or as mobile control rooms or control stations with an office-like interior arrangement.

The container building 10 in this case is constructed on the basis of an integral reefer, that is to say on the basis of a commercially available refrigerated container 12 adapted for the conveyance of perishable goods in sea freight shipping, for example for the conveyance of foodstuffs and/or medicines. Accordingly, the container 12 in the preferred exemplary embodiments preferably has the dimensions of a commercially available ISO container for sea freight shipping. The container in the illustrated exemplary embodiment is a 20-foot integral reefer.

The container 12 has a floor panel 14, a ceiling panel 16 and side walls 18, which together define an interior space 20 having a longitudinal extent in the direction of arrow 22. An interior arrangement 24 is operationally permanently installed in the interior space 20. The expression "operationally permanently" is used here to denote that the majority of the parts of the interior arrangement 24 remain in the interior space 20 during the operation of the container building as intended and are secured there for their intended application.

The container 12 has in a manner known per se a box-shaped frame structure 26, which can be made from steel profiles, for example. The floor panel 14 can also be made from steel, in order to reliably support the total weight of the container including the interior arrangement 24, including under harsh transport conditions. The frame structure 26 is typically configured to carry the weight of at least one further container, which can be set down on the ceiling panel 16 or on the outer vertical columns of the frame structure 26, as is customary in sea freight shipping. By contrast, the side walls 18 in this case are made of aluminum or are manufactured with some other lightweight construction. The side walls in this case are double-wall insulated and are clad substantially seamlessly with stainless steel sheets 28 in the interior space 20 (see the detailed representation in FIG. 5).

Figure 4:
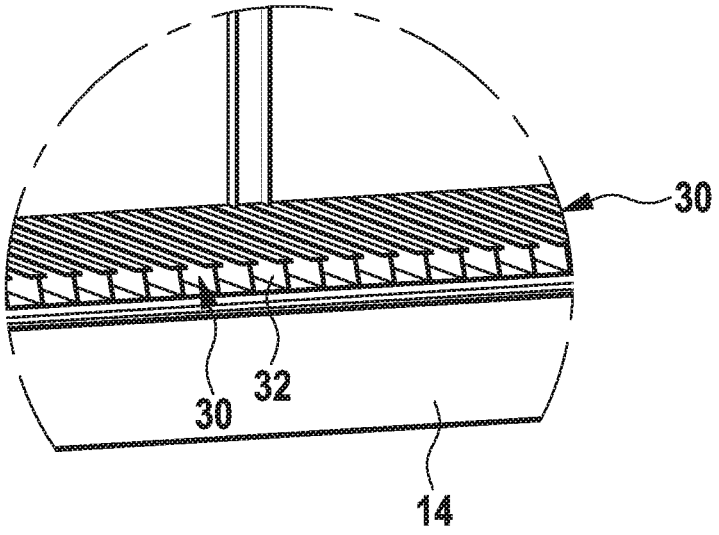
FIG. 4 shows the ribbed structure of the container building of FIG. 2 as a detailed view.

As is customary for an integral reefer, the container building 10 has on its floor panel 14 a ribbed structure 30, which extends in the longitudinal direction 22 over the entire floor panel 14. The ribbed structure 30 typically includes one or a plurality of extruded aluminum profiles and comprises a plurality of ribs 32 evenly spaced apart from one another, which extend in the longitudinal extent 22 in the manner of a comb and form a plurality of ducts evenly spaced apart from one another (see FIG. 4). Dimensional accuracy of the ribbed structure and, in particular, the lateral distances of the individual ribs 32, is not critical, so that the expression "evenly" in this case mainly indicates that practically the whole of the floor panel 14 is covered in the interior space 20 with ribs 32. Typically, the ducts 34 of the ribbed structure 30 are used in an integral reefer laden to the customary commercial level for the circulation of the cooling air, whereas the goods to be transported are set down on the ribbed structure 30.

Figure 3:
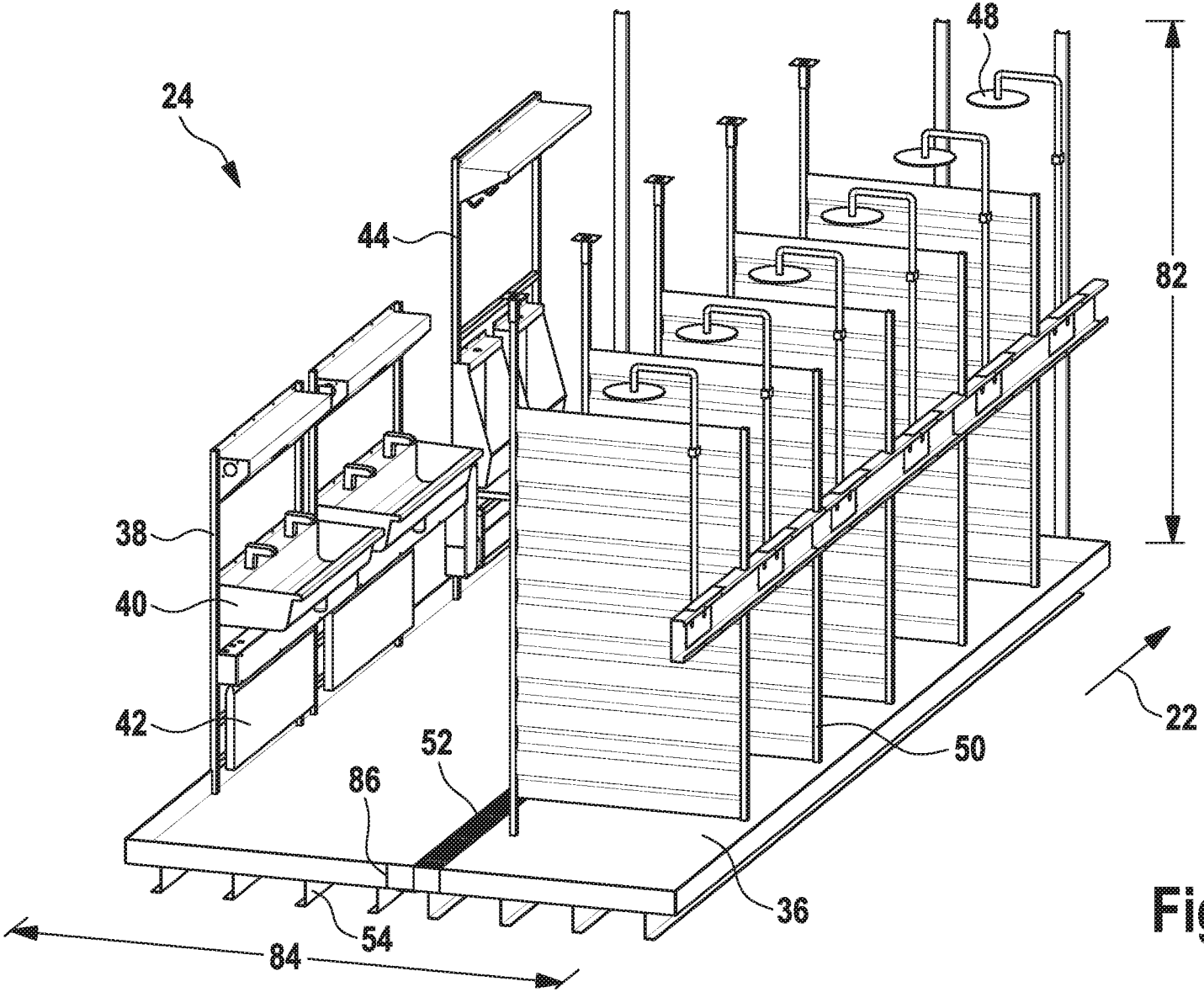
FIG. 3 shows substantial parts of the interior arrangement of the container building of FIGS. 1 and 2 on a steel sheet.

However, a steel sheet 26 is secured to the ribbed structure 30 in the present application of the integral reefer 12. The steel sheet 36 supports the majority of the interior arrangement 24, as can be seen in FIG. 3. In the illustrated embodiment, the steel sheet 36 supports two racks 38, for example, in each of which a large double wash basin 40 and a heating radiator 42 are secured. A further rack 44 forms a coat and hat stand and carries a bench seat 46. In addition, the interior arrangement 24 in this case comprises a plurality of shower heads 48 and shower partition walls 50. All the aforementioned parts of the interior arrangement 24 are pre-assembled and secured on the steel sheet 36 in the preferred exemplary embodiments and are moved together with the steel sheet 36 into the interior space 20 when the container building 10 is assembled. A characteristic feature of the container building 10, therefore, is that the major, function-determining parts of the interior arrangement, in this case the wash basins 40, the heating radiator 42 and the shower cubicles, by way of example, are supported for the most part on the steel sheet 36. The steel sheet 36 bears the weight of these parts largely or even entirely. Securing of the racks 38, 44 and shower partition walls 50 to the interior sides of the walls 18 is advantageous, however, in order to prevent clanging, rattling, banging and the like during transport or during their intended use. In each case, the steel sheet carries more than 50% of the respective weight of the function-determining parts.

In the illustrated exemplary embodiment, the load-bearing steel sheet 36 comprises an integrated water drainage duct 52 extending in the longitudinal direction 22. The shower water can be collected via the drain duct 52 and led away to the outside from the interior space 20 of the container.

As can be seen in FIG. 3, vertical steel profiles 54 are arranged on the side of the steel sheet 36 facing away from the interior space, which profiles likewise extend in the longitudinal direction 22. The profiles 54 are made from steel in some exemplary embodiments.

Figure 5:
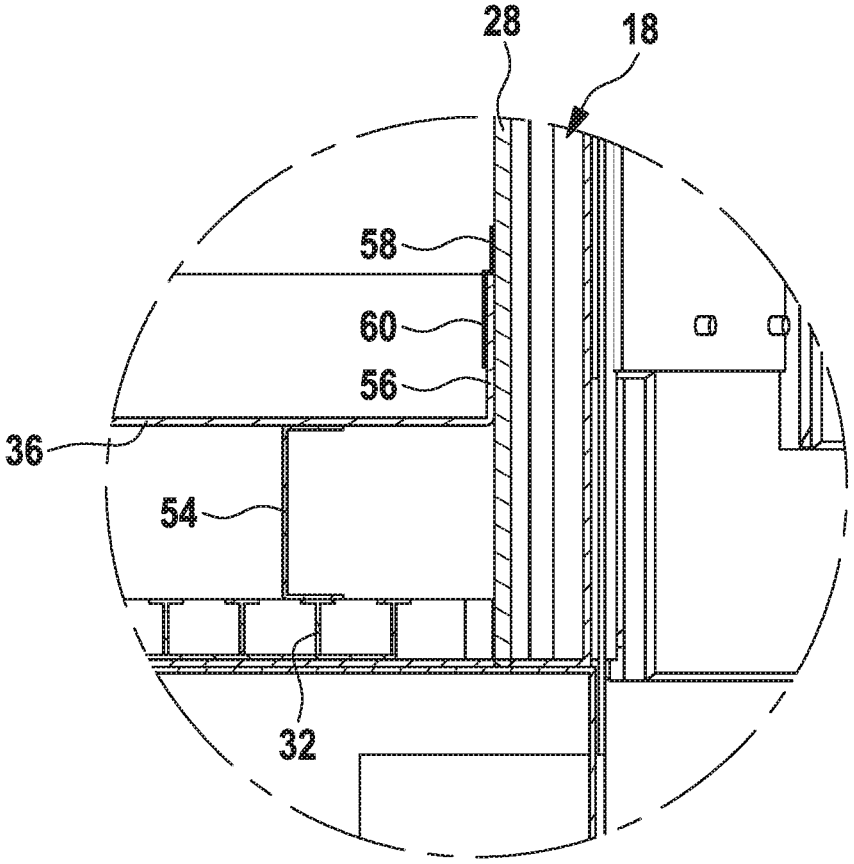
FIG. 5 shows a further detailed view, which shows the connection of the steel sheet to the side wall of the container of FIGS. 1 and 2.

As can be seen in FIG. 5, the steel sheet 36 has an upward-projecting end surface 56 in the region of the side walls 18, which end surface is produced, for example, by an L-shaped folded edge of the steel sheet 36. The end surface 56 is oriented largely parallel to the stainless steel sheet 28 of the side wall 18. Mounted on the side wall 18 in the working area or the functional area is a circumferential sealing membrane 58, which comprises a downward-projecting section 60. The section 60 engages around the end surface 56 from above. In some exemplary embodiments, an elastic sealing material (not illustrated here), such as a rubber seal or a silicon strip, is arranged between the end surface 56 and section 60. The end surface 56 and the sealing membrane 58 form a labyrinth seal, via which the steel sheet 36 bears against the inside of the side wall 18 in a liquid-tight manner.

As can be further seen in FIG. 5, the steel profiles 54 are positioned on the ribs 32 of the ribbed structure. Such a construction makes it easier to push the pre-assembled interior arrangement 24 into the interior space 20 of the container 12 with a fork-lift truck and to set it down there. In other exemplary embodiments, the steel sheet 36 can be arranged directly on the ribbed structure 30.

As can be appreciated in FIG. 2, the steel sheet 36 does not cover the entire area of the ribbed structure 20. Rather, the steel sheet 36 is shorter in the longitudinal direction 22 than the interior space 20 of the container 12. At the interior end of the steel sheet 36, an interior wall 62 is mounted in the interior space 20. The interior wall 62 separates the functional area and/or the working area for the deployed personnel, in this case being the sanitary area, from a technical space 64. In the preferred exemplary embodiments, the interior wall 62 is mounted only after the steel sheet 36 has been pushed into the interior space 20. The interior wall 62 preferably separates the functional area and the working area completely from the technical space 64. As a result, the interior wall 62 in the preferred exemplary embodiments bears seamlessly against the interior stainless steel sheets 28 of the side walls 18 and against the inside of the ceiling panel 16. It can be sealed with a sealing material.

In the preferred exemplary embodiments, various technical apparatuses, which are actually required for the operation of the container building as intended, but which must not be directly accessible in the functional area and/or the working area, are accommodated in the technical space 64. In the present exemplary embodiment, the apparatuses include a control cabinet 66 for the electrical installation as well as a hot water tank 68. Furthermore, a burner or some other heating system for heating the water in the tank 68, as well as pumps and other apparatuses (not illustrated here), can be arranged in the technical space 64.

In the exemplary embodiment according to FIG. 2, the container 12 has at its technical space end a door structure having two large door leaves 70, which, in the opened state, expose practically the entire technical space 64. A smaller door 72, which permits easy access into the technical space 64, is arranged in addition in the door wing 70 on the left-hand side in FIG. 2.

In other exemplary embodiments, an exterior wall 74 can be secured to the frame structure 26 in place of the double door with the door leaves 70. The exterior wall 74 can advantageously be secured to the already existing mounting holes 76 of the frame structure 26 of an integral reefer 12. A simple access door 72, which permits access into the technical space 64 for maintenance work, such as the replacement of a fuse in the control cabinet 66, is let into the exterior wall 74. The exemplary embodiment with the securely mounted exterior wall 74 permits greater stability of the container building and as such is preferred for some applications.

Figure 6:
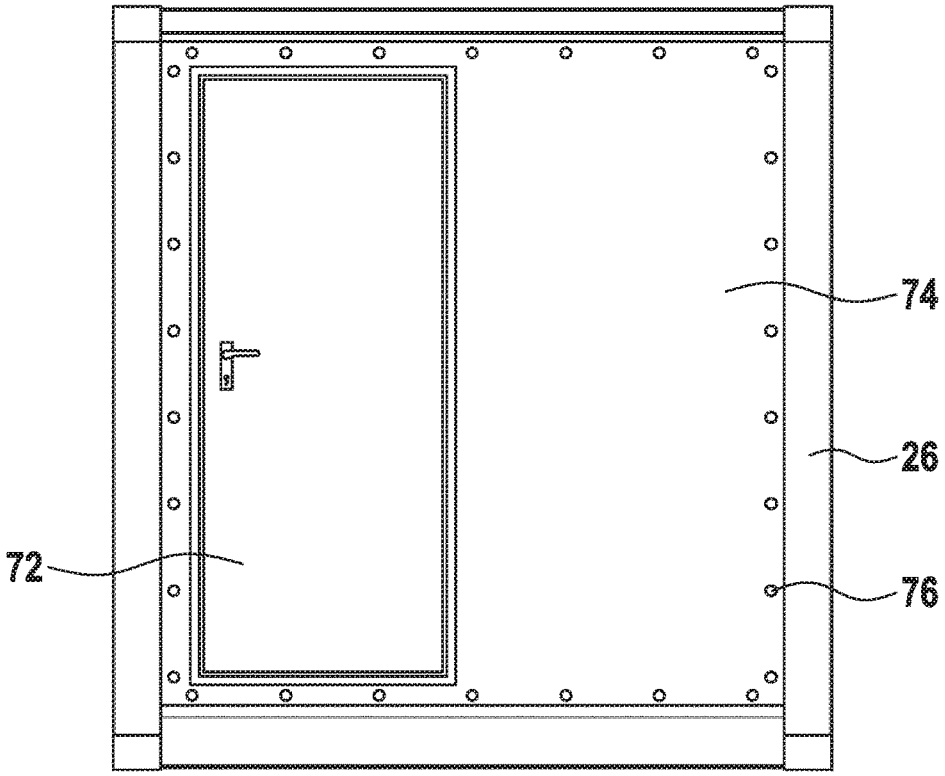
FIG. 6 shows the container building of FIG. 2 with an alternative exterior wall at the rear end.

In addition, the container building 10 in the preferred exemplary embodiments has a "typical" double door of an ISO freight container on the narrow side facing away from the technical space 64 (not represented in FIG. 1). As an alternative hereto, the "typical" container double door could be arranged on the side of the technical space 64, and a mounting wall having an integrated access door 72 according to the representation in FIG. 6 may be mounted on the narrow side of the container 12 represented in FIG. 1.

In the preferred exemplary embodiments, in which the steel sheet 36 with the pre-assembled interior arrangement 24 is moved into the interior space 20 of the container 12, this takes place through the "typical" container double doors of an ISO freight container. These double doors thus provide an access opening with an unobstructed interior height 78 and an unobstructed interior width 80. The pre-assembled interior arrangement 24 advantageously has a static installation height 82, which is smaller than the unobstructed interior height 78 of the container access opening, in order to permit the pre-assembled interior arrangement 24 to be pushed in. If individual parts of the interior arrangement 24, such as the partition walls 50 depicted here, are to be secured to the interior ceiling of the container 12, this can take place after the interior arrangement 24 with corresponding intermediate pieces or extension pieces has been pushed in. In the preferred exemplary embodiments, the installation width 84 of the interior arrangement 24 is also narrower than the unobstructed interior width 80 of the container 12. In some exemplary embodiments, the steel sheet 36 can be of two-part or multi-part configuration, as indicated in relation to the parting line 86 in FIG. 3, in order to facilitate the pushing-in of the interior arrangement 24 into the container interior space 20.

Figure 7:
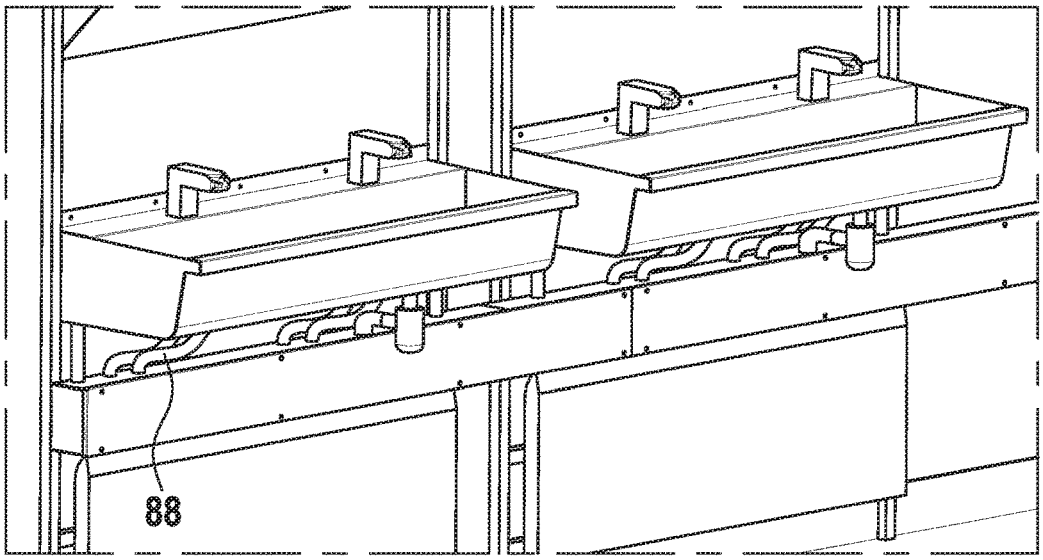
FIG. 7 shows a detail of the interior arrangement of FIG. 3.

In the preferred exemplary embodiments, the supply lines and connection lines are routed visibly in the interior space 20, as illustrated in FIG. 7 in the case of the water supply pipes 88 for the wash basins. Electrical connection cables, in particular such as those for the connection of a ceiling lighting system (not represented here) in the interior space 20, are likewise visible, that is to say routed "on wall" in some cases. This does not exclude the possibility of the cables in question being routed in a separate duct, wherein this separate duct is then routed visibly on the ceiling, the side walls 18 and/or frame parts of the (pre-assembled) interior arrangement 24.

In all the preferred exemplary embodiments, the novel container building is based on the use of a commercially available refrigerated container, in particular an integral reefer container, of the kind typically used for the transport of foodstuffs or other perishable goods in sea freight shipping. A load-bearing steel sheet, which supports the principal load of the function-determining parts of the interior arrangement 20, is arranged on the existing ribbed structure. The comparatively weak side walls of the reefer containers can be relieved of load-bearing tasks in this way.

What is claimed is:

1. A mobile container building for personnel deployed for at least one of military, humanitarian or expeditionary operations, comprising:

a transportable container having a floor panel, a ceiling panel and side walls, which together define an interior space having a longitudinal extent, and an interior arrangement, which defines a functional working area within the interior space for the personnel deployed, wherein the interior arrangement is installed in an operationally permanent manner in the interior space, wherein the floor panel comprises a ribbed structure having a plurality of ribs evenly spaced apart from one another on a side oriented towards the interior space, with the ribs extending in the longitudinal extent and forming a plurality of ducts evenly spaced apart from one another, wherein a load-bearing steel sheet is secured onto the ribbed structure, wherein the load-bearing steel sheet substantially covers the ribbed structure, and wherein the load-beating steel sheet carries the interior arrangement.

2. The mobile container building of claim 1, wherein the side walls facing towards the interior space are seamlessly clad with stainless steel sheets or aluminum sheets.

3. The mobile container building of claim 1, wherein the load-bearing steel sheet completely covers the ribbed structure in the functional working area.

4. The mobile container building of claim 3, wherein the load-bearing steel sheet has an upward-projecting end surface in the region of the side walls, and wherein a downward-projecting sealing diaphragm is arranged on the side walls, wherein the downward-projecting sealing diaphragm engages from above around the upward-projecting end surface.

5. The mobile container building of claim 1, wherein the side walls have a multi-layer structure with an integrated insulation material.

6. The mobile container building of claim 1, wherein the transportable container is a refrigerated container approved for sea freight shipping.

7. The mobile container building of claim 6, wherein the transportable container is an integral reefer container.

8. The mobile container building according to claim 6, wherein the refrigerated container has a frame structure with mounting holes, and wherein an exterior wall with an integrated access door is secured to the mounting holes.

9. The mobile container building of claim 1, further comprising lighting arranged on the ceiling panel and oriented towards the interior space, which lighting has electrical connecting cables routed openly or routed inside a visible cable duct.

10. The mobile container building of claim 1, wherein the container comprises, transversely to the longitudinal extent, an access opening having an unobstructed interior height and an unobstructed interior width, and wherein the interior arrangement has a static installation height that is smaller than the unobstructed interior height.

11. The mobile container building of claim 1, wherein the load-bearing steel sheet extends in the longitudinal extent over only a part of the ribbed structure, and wherein an interior wall, which delimits the functional working area, is secured at the end of the load-bearing steel sheet.

12. The mobile container building according to claim 11, further comprising technical supply units arranged on the ribbed structure on a side of the interior wall facing away from the functional working area.

13. The mobile container building of claim 1, wherein the interior arrangement has a total weight and the load-bearing steel sheet carries more than 75% of the total weight.

14. The mobile container building of claim 13, wherein the load-bearing steel sheet carries more than 90% of the total weight.

15. The mobile container building of claim 1, wherein the load-bearing steel sheet comprises a water drainage duct extending in the longitudinal extent.

16. The mobile container building of claim 1, wherein the interior arrangement comprises at least one of cupboards, work tables, coat racks, benches, computers, heaters, wash basins, toilets or showers, which are respectively supported on the load-bearing steel sheet.

17. A mobile container building for personnel deployed in military, humanitarian or expeditionary operations, comprising a transportable container having a floor panel, a ceiling panel and side walls, which together define an interior space having a longitudinal extent, with the floor panel having a ribbed structure comprising a plurality of ribs extending in the longitudinal extent and forming a plurality of ducts evenly spaced apart from one another, a load-bearing steel sheet secured onto the ribbed structure so as to cover the ribbed structure, and an interior arrangement defining an operating area within the interior space for the personnel deployed, wherein the interior arrangement has a total weight, wherein the load-bearing steel sheet completely covers the ribbed structure in the operating area, and wherein the interior arrangement is installed in an operationally permanent manner on the load-bearing steel sheet, wherein the load-bearing steel sheet supports more than 75% of the total weight.

18. The mobile container building of claim 17, wherein the load-bearing steel sheet supports more than 90% of the total weight.

19. The mobile container building of claim 17, wherein the transportable container is an integral reefer container.

* * * * *